US011827444B2

(12) United States Patent
Hung et al.

(10) Patent No.: US 11,827,444 B2
(45) **Date of Patent: *Nov. 28, 2023**

(54) NESTING PACKAGING DESIGN FOR PLANTERS

(71) Applicant: ATT Southern, Inc., Camp Hill, PA (US)

(72) Inventors: Chun Hung, Dillsburg, PA (US); Brian Leahy, Atlanta, GA (US); Patrick Guillory, Smyrna, GA (US); Phillip Lemke, Schuylkill Haven, PA (US); John Carpenter, Camp Hill, PA (US)

(73) Assignee: ATT Southern LLC, Camp Hill, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/950,253

(22) Filed: Sep. 22, 2022

(65) Prior Publication Data

US 2023/0017621 A1 Jan. 19, 2023

Related U.S. Application Data

(60) Continuation of application No. 16/568,732, filed on Sep. 12, 2019, now Pat. No. 11,453,545, which is a (Continued)

(51) Int. Cl.

| | |
|---|---|
| ***B65D 85/62*** | (2006.01) |
| ***B65D 5/42*** | (2006.01) |
| ***B65D 5/50*** | (2006.01) |

(52) U.S. Cl.
CPC ..... *B65D 85/62* (2013.01); *B65D 5/42* (2013.01); *B65D 5/5019* (2013.01); *B65D 5/5021* (2013.01)

(58) Field of Classification Search
CPC ..... B65D 5/42; B65D 5/5019; B65D 5/5021; B65D 85/62; B65D 85/321;
(Continued)

(56) References Cited

U.S. PATENT DOCUMENTS 1,059,359 A 4/1913 Hahn
1,116,694 A 11/1914 Hahn
(Continued)

*Primary Examiner* — Christopher R Demeree
(74) *Attorney, Agent, or Firm* — Brooks Kushman P.C.

(57) ABSTRACT

A planter packaging arrangement is disclosed that comprises a packaging element and at least one planter mounter therein. The packaging element includes a bottom surface, a top surface and two pairs of opposing side walls collectively defining a generally enclosed space. A first opening is defined through the top surface and aligned with a second opening defined through the bottom surface of the packaging element. The at least one planter is mounted within the packaging element, with an open top end disposed within the enclosed space of the packaging element. The second opening is aligned with the open top end such that an interior of the planter is accessible through the second opening of the bottom surface of the packaging element. A portion of the body portion extends through the first opening of the top surface of the packaging element such that the bottom surface is disposed above the top surface.

20 Claims, 11 Drawing Sheets

Related U.S. Application Data division of application No. 15/615,317, filed on Jun. 6, 2017, now Pat. No. 10,450,128, which is a continuation of application No. 29/586,077, filed on Nov. 30, 2016, now Pat. No. Des. 862,282, which is a continuation of application No. 29/567,117, filed on Jun. 6, 2016, now Pat. No. Des. 837,094.

(60) Provisional application No. 62/346,202, filed on Jun. 6, 2016.

(58) Field of Classification Search

CPC ..... B65D 21/0209; B65D 21/0233; B65D 2571/00895; B65D 5/001; B65D 77/0433

USPC ..... 229/175, 915; D11/143; 206/423, 499; 47/84, 901; 211/126.1

See application file for complete search history.

(56) References Cited

U.S. PATENT DOCUMENTS 1,146,515 A 7/1915 Potter
1,625,620 A 4/1927 Maston
D199,335 S 10/1964 Glazer
3,414,132 A 12/1968 Cornu
3,635,361 A * 1/1972 Hayes ..... B65D 21/0224 206/510
3,696,987 A * 10/1972 Schuff ..... B65D 21/0233 206/520
3,791,552 A 2/1974 Hayes
D232,753 S 9/1974 Jalakas
D238,088 S 12/1975 Grosfillex
4,236,353 A 12/1980 Sorenson
4,618,069 A 10/1986 Quong
4,664,260 A 5/1987 Stokes
5,141,149 A 8/1992 Fulton
D340,204 S 10/1993 Grosfillex
D361,738 S 8/1995 Shryock
D361,933 S 9/1995 Meyer et al.
5,522,537 A 6/1996 Barlow
D376,769 S 12/1996 Kreidler
D392,914 S 3/1998 Friend
D399,456 S 10/1998 Weder et al.
D428,360 S 7/2000 Herzog-Mesrobian
6,102,204 A 8/2000 Castleberry
D438,487 S 3/2001 Madden, IV
6,422,390 B1 7/2002 Humphrey
6,516,563 B1 2/2003 Matthews
D480,326 S 10/2003 Carlson
D491,061 S 6/2004 Bouroullec et al.
7,017,798 B2 3/2006 Pope et al.
7,118,023 B2 * 10/2006 Holdsworth ..... B65D 5/0035 229/164
D532,715 S 11/2006 Schmidt
7,140,149 B2 11/2006 Searle et al.
D552,469 S 10/2007 Harmon
D556,567 S 12/2007 Templeton
D570,245 S 6/2008 McAbee
D571,688 S 6/2008 White
D643,993 S 8/2011 Biegel
D686,913 S 7/2013 Kirk et al.
D688,589 S 8/2013 Hung et al.
D689,793 S 9/2013 Yung
D702,548 S 4/2014 Flury
D724,481 S 3/2015 Blouin
8,985,329 B2 3/2015 Ullrich
D730,770 S 6/2015 LaRosa, Jr. et al.
D745,428 S 12/2015 Morris
D748,469 S 2/2016 Snedden et al.
D763,105 S 8/2016 Forowycz et al.
D765,544 S 9/2016 DeYoung et al.
D779,934 S 2/2017 Parikh et al.
9,586,739 B2 3/2017 Jego
9,676,511 B2 6/2017 Kaltman et al.
D801,213 S 10/2017 Kim
D805,423 S 12/2017 Thuma et al.
D822,425 S 7/2018 Menicanin et al.
D843,829 S 3/2019 Brown
D876,879 S 3/2020 Samoff et al.
D922,187 S 6/2021 Bouveret
2005/0072704 A1 4/2005 Patz et al.
2009/0184020 A1 * 7/2009 Messerschmid ..... B65D 3/14 493/84
2011/0174656 A1 * 7/2011 D'Amato ..... B31F 1/0038 206/505
2013/0036669 A1 2/2013 Rabii et al.
2015/0034710 A1 * 2/2015 Kaltman ..... B65D 5/563 229/175

* cited by examiner

NESTING PACKAGING DESIGN FOR PLANTERS

CROSS-REFERENCE TO RELATED APPLICATIONS

This application is a continuation of U.S. application Ser. No. 16/568,732 filed Sep. 12, 2019, now U.S. Pat. No. 11,453,545, which is a division of U.S. application Ser. No. 15/615,317 filed Jun. 6, 2017, now U.S. Pat. No. 10,450,128 B2, which is a continuation of U.S. Design application Ser. No. 29/567,117, filed Jun. 6, 2016, now U.S. Pat. No. D837,094 S and is a continuation of U.S. Design application Ser. No. 29/586,077, filed Nov. 30, 2016, now U.S. Pat. No. D862,282 S, and claims the benefit of U.S. provisional application Ser. No. 62/346,202 filed Jun. 6, 2016, the disclosures of which are hereby incorporated in their entirety by reference herein.

TECHNICAL FIELD

The present disclosure relates generally to a product packaging arrangement for planters.

BACKGROUND

Packaging for planters for transport and storage present certain challenges. For example, planters have open top end and are typically tapered inward toward a substantially closed bottom surface. To package the planters effectively for transport and storage, each planter is traditionally individually packaged in a closed box. However, such arrangements result in significant bulk, much of the interior of the box including wasted space. Thus, more transport space is needed to transport traditionally boxed planters, thereby increasing costs for transporting such planters. Moreover, the boxes do not secure together, thus may be susceptible to moving or falling over during transport. Further, storage of the traditionally boxed planters is also an issue. Individually boxed planters take up significant space.

Another issue is that the planters are not visible to the end consumer in traditionally boxed arrangements. Either marketing images need to be positioned on the exterior of the box or each box must be opened and the planter taken out at a point of purchase display. Either option increases costs.

What is needed is a planter packing arrangement that provides more efficient space management for both transport and storage, as well as providing visibility of the planter to the end consumer.

SUMMARY

A first exemplary configuration of a planter packaging arrangement comprises a packaging element and at least one planter. The packaging element is defined by a first element and a second element. The first element is defined by a bottom surface, and two pairs of opposing side walls that extend upwardly from the bottom surface and define a generally open top surface, the bottom surface further defines a first opening therethrough. The second element is defined by a top surface and two pairs of opposing side walls that extend downwardly from the top surface and define a generally open bottom surface, the top surface further defines a second opening therethrough. The at least one planter is mounted within the first element, the planter defined by a bottom surface, an open top end and a body portion therebetween.

The open top end of the at least one planter is disposed within the first element of the packaging element with the open top end of the at least one planter being aligned with the first opening such that an interior of the at least one planter is accessible through the first opening of the bottom surface of the first packaging element. The second element is connected to the first element such that a portion of the body portion of the at least one planer extends through the second opening of the top surface of the packaging element such that the bottom surface of the at least one planter is disposed above the top surface of the second packaging element.

In a second exemplary, a planter packaging arrangement comprises a unitary packaging element defined by a first element and a second element joined together by a sidewall member. The first element has a first opening and the second element has a second opening. At least one planter is mounted within the first opening, the planter defined by a bottom surface, an open top end and a body portion therebetween. The second element of the packaging element is selectively pivotable about the side wall member such that the first element is parallel to the second element and the second opening is aligned with the open top end of the at least one planter such that an interior of the at least one planter is accessible through the second opening of the packaging element. The second element is connected to the first element to capture the open top end of the at least one planter within an interior defined by the packaging element.

DETAILED DESCRIPTION

Figure 1:
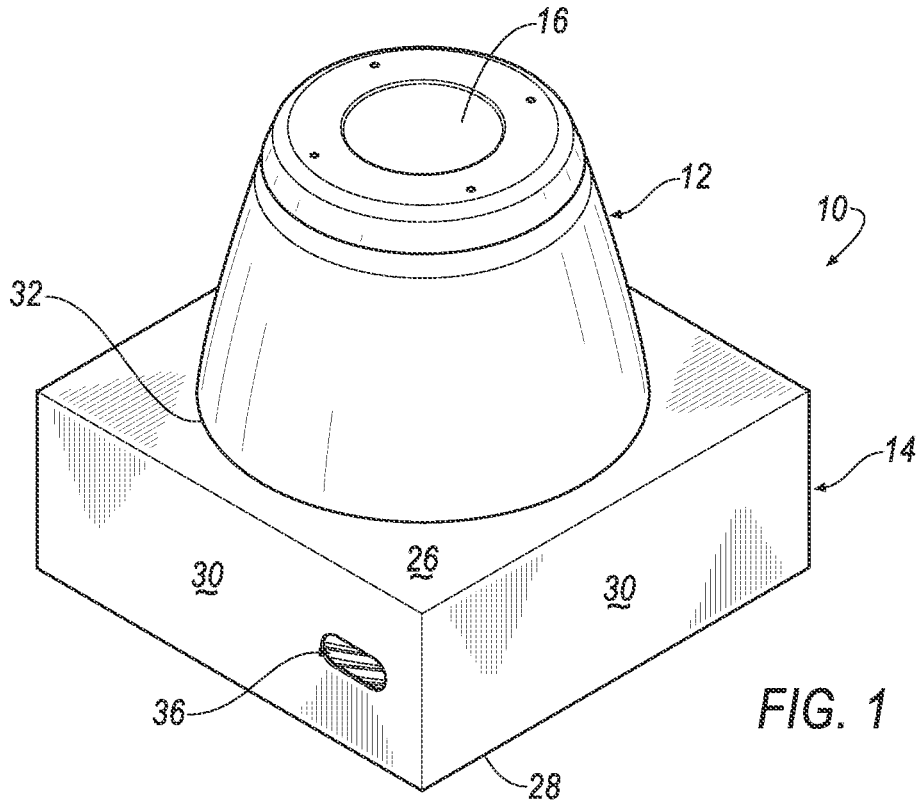
FIG. 1 is a top perspective view of an individual planter packaging arrangement.

Referring now to the drawings, illustrative examples are shown in detail. Although the drawings represent certain examples of the disclosure, the drawings are not necessarily to scale and certain features may be exaggerated to better illustrate and explain an innovative aspect of an example. Further, the examples described herein are not intended to be exhaustive or otherwise limiting to the precise form and configuration shown in the drawings and disclosed herein.

Referring to FIGS. 1-5, an individual planter packaging arrangement 10 is shown. The individual planter packaging arrangement 10 includes a planter 12 partially mounted in a packaging element 14. The planter 12 is defined by a generally closed bottom surface 16, a top edge 18 (shown in phantom in FIG. 3) extending around an open top end 20 and a body portion 22 extending between the bottom surface 16 and the open top end 20. The bottom surface 16 is configured with a cross-sectional area that is smaller than a cross-sectional area of the open top end 20. In this manner, the body portion 22 flares or tapers outwardly from the bottom surface 16 to the open top end 20. In one arrangement, the body portion 22 further includes an outer rim element 24 disposed on an outer surface of the body portion 22 that extends from open top end 20. Alternatively, the top edge 18 may flare outwardly from the body portion 22, similar to a bell.

The packaging element 14 is defined by spaced apart generally opposing top 26 and bottom 28 surfaces that are joined together by four sidewalls 30. In one exemplary arrangement, portions of the sidewalls 30 may be integral with the top 26 and bottom 28 portions. The top surface 26 includes a first opening 32 disposed therethrough. The bottom surface 28 includes a second opening 34 disposed therethrough. The first and second openings 32, 34 are generally aligned such that a central axis extends through a center of both first and second openings 32, 34. However, as will be explained in further detail below, the first opening 32 has a first diameter that is smaller than a second diameter of the second opening 34.

In one exemplary arrangement, opposing sidewalls 30 may be configured with one or more grasping elements 36. In one exemplary arrangement the grasping element 36 is configured as a deformable portion 38 of the sidewall 30. More specifically, sides 40 and bottom edge 42 of deformable portion 38 may be perforated such that a force exerted onto the deformable portion 38 will permit a portion of the sidewall 30 to be forced toward an interior of the packaging element 14, pivoting about a top edge 44 of the deformable portion 38 to create an opening 46 into which fingers or a part of a hand may extend to grasp the packaging element 14.

It is understood, however, that the disclosure is not restricted to this particular arrangement and that either one of the sides 40 or the bottom edge 42 may remain unperforated and the top edge 44 may be perforated to still allow the deformable portion 38 to be forced toward the interior of the packaging element 14. As yet another alternative, the bottom edge 42, top edge 44 and side edges 40 may all be perforated and any force exerted on to the deformable portion 38 allows the deformable portion 38 to break away from the sidewall 30 to define the openings 46. As yet another exemplary arrangement, the sidewalls 30 may simply be provided with the openings 46. While the arrangement shown in the drawings illustrate that the grasping elements are formed on two opposing sidewalls 30, it is also contemplated that all four side walls may be provided with the grasping elements.

Figure 2:
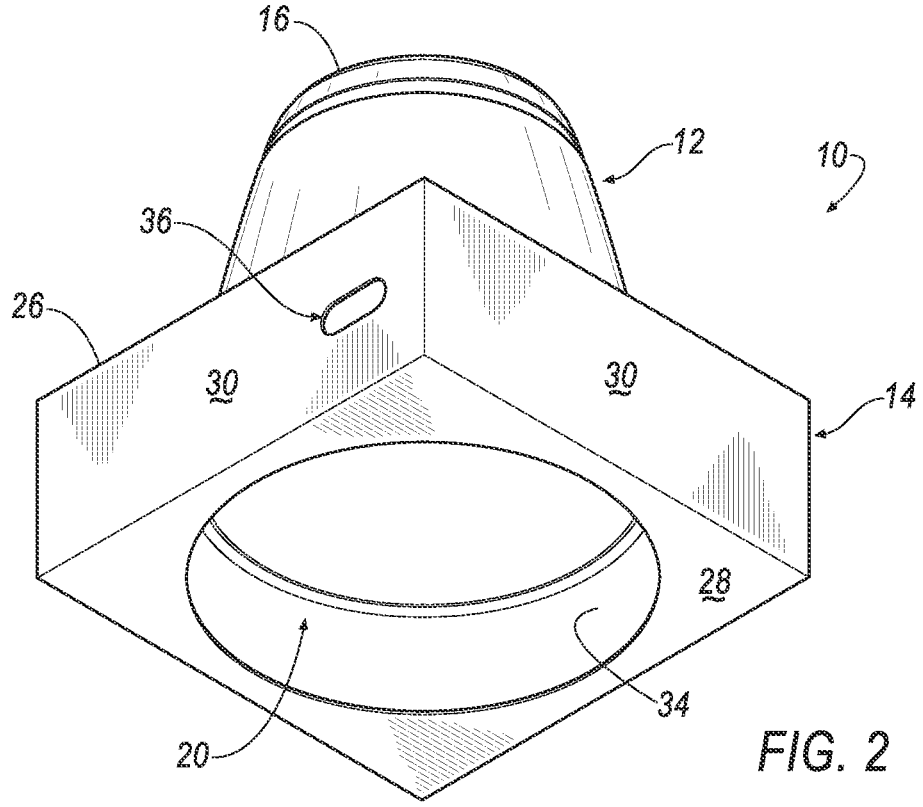
FIG. 2 is a bottom perspective view of the individual planter packaging arrangement of FIG. 1.
Figure 3:
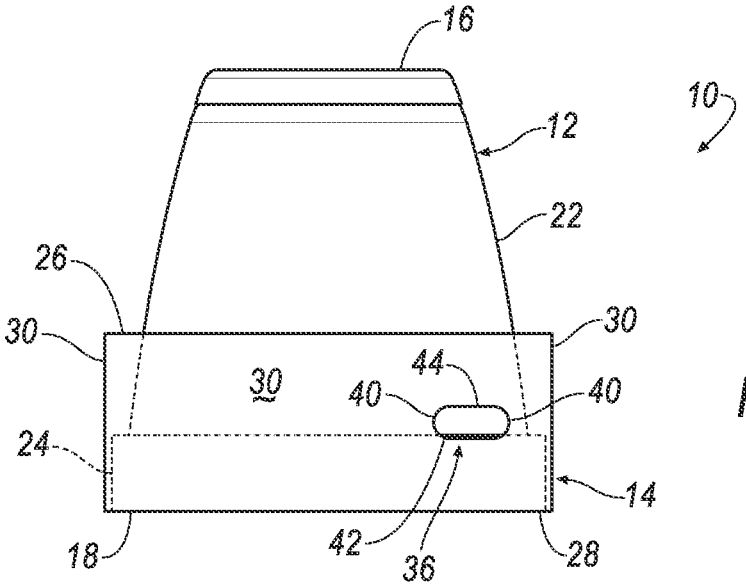
FIG. 3 is an elevational view of the individual planter packaging arrangement of FIG. 1.
Figure 4:
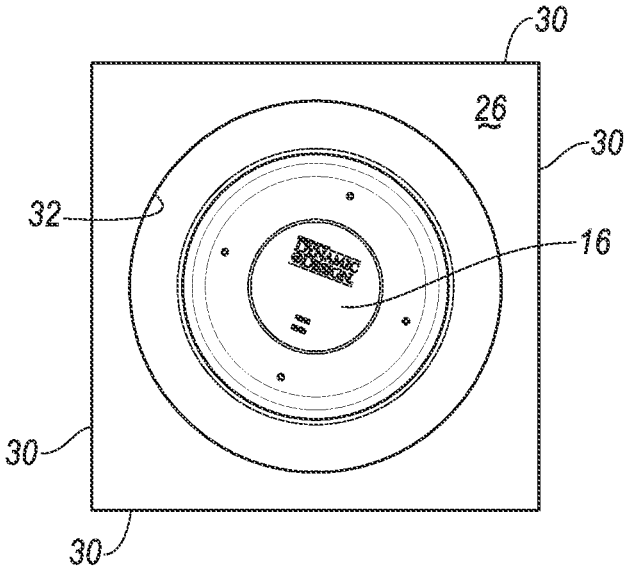
FIG. 4 is a top plan view of the individual planter packaging arrangement of FIG. 1.
Figure 5:
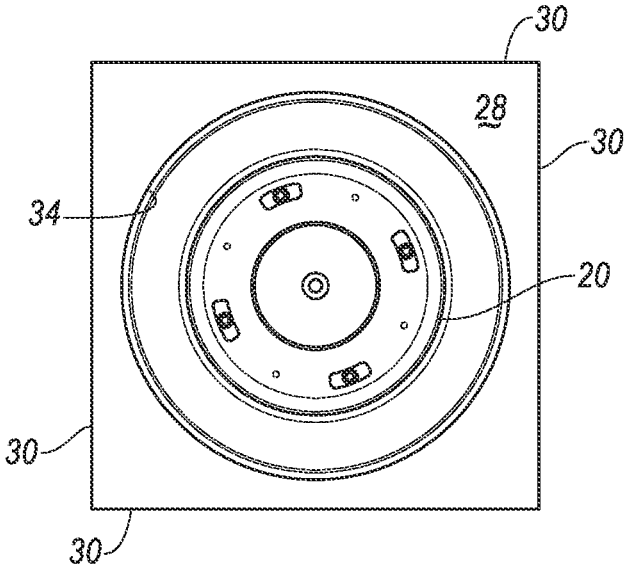
FIG. 5 is a bottom plan view of the individual planter packaging arrangement of FIG. 1.

The planter 12 is mounted within the packaging element 14. In one exemplary arrangement, the bottom surface 28 may be pivoted away from the top surface 26 and the planter 12, due to a fold line 41 that serves as a hinge. The bottom surface 28 is turned upside down from its normal use configuration and the bottom surface 16 of the planter 12 is inserted through the first opening 32. The first opening 32 will serve as a stop to retain a portion, i.e., the top edge 18, of the planter 12 beneath the top surface 26. Once the bottom surface 16 has been inserted through the first opening 32, the bottom surface 28 may be pivoted back along fold line 41 so as to oppose the first surface 26 and the sidewalls 30 are connected between the top 26 and bottom 28 surfaces by any suitable manner, thereby capturing the top edge 18 of the planter 12 within the interior of the packaging element 14, as shown in FIG. 2. The second opening 34 will be disposed beneath the open top end 20 of the planter 12. In one exemplary arrangement, the second opening 34 is sized to be slightly smaller than the open top end 20, such that the top edge 18 may rest on the bottom surface 28 in the interior of the packaging element 14.

In one exemplary arrangement, a stabilizing element (not shown) may be provided within the interior of the packaging element 14. The stabilizing element may take the form of a Styrofoam ring. The ring may be disposed over the bottom surface 16 of the planter 12 and have a thickness to substantially fill the empty space within the interior of the packaging element 14 and prevent unwanted movement of the planter 12 within the interior of the packaging element 14.

Instead of a Styrofoam ring, the stabilizing element may include a top surface having an opening that corresponds to the first opening 32 of the packaging element 14, two opposing sidewalls integrally attached to the top surface of the stabilizing element and to a bottom surface that includes an opening that corresponds to the second opening 34. The remaining sides are open.

Figure 6:
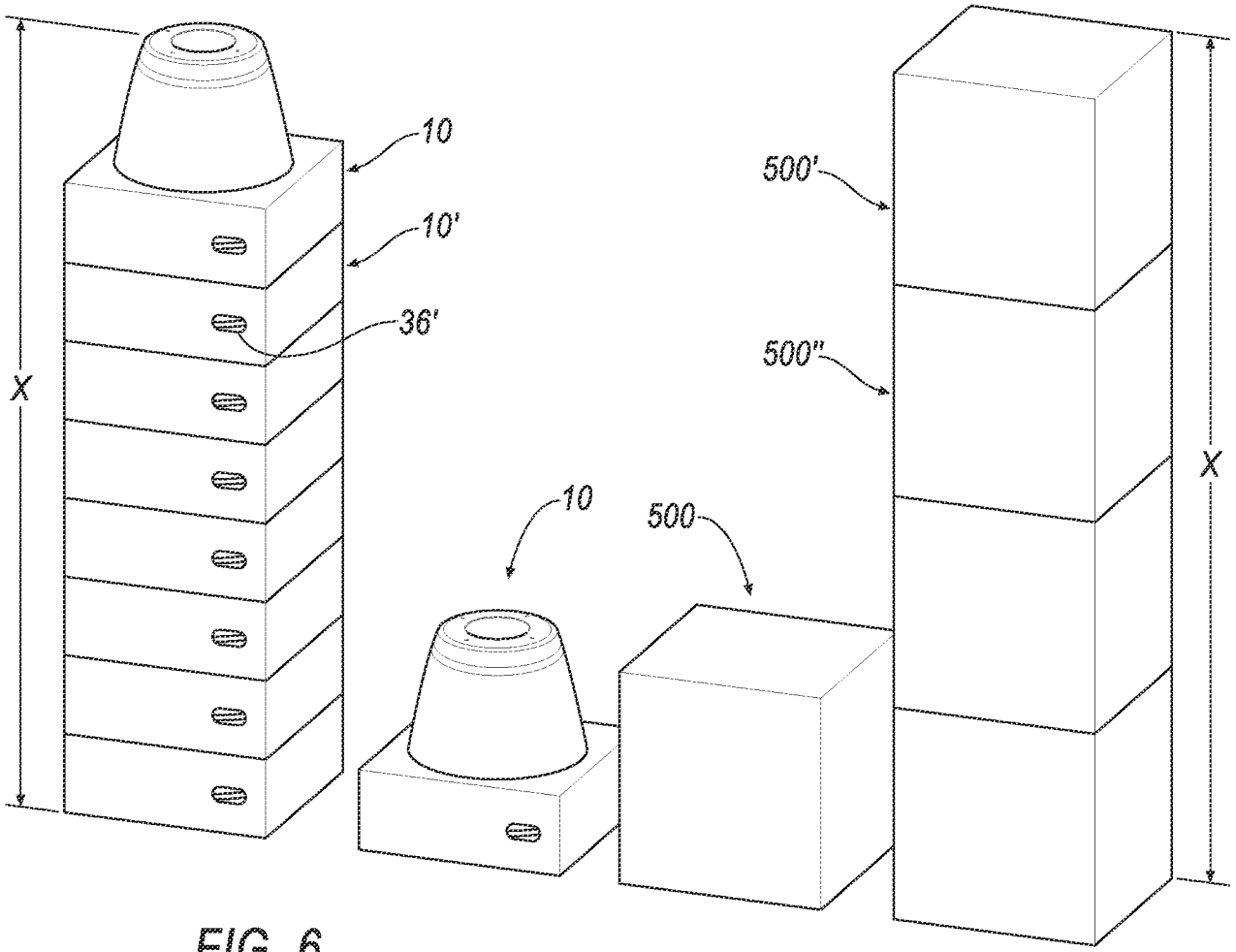
FIG. 6 is a perspective view of a stack of the individual planter packaging arrangement of FIG. 1, compared with a stack of traditional individual planter packaging arrangements.

The planter packaging arrangement 10 permits selective stacking of successive planters 12 in a much more compact manner than traditional packaging arrangements. As shown in FIG. 6, a first individual planter packaging arrangement 10 is disposed over a second individual planter packaging arrangement 10'. The bottom surface of the planter 12 for the second individual planter packaging arrangement 10' extends through the second opening 34 of the first individual planter packaging arrangement 10 to nest within the body portion 22 of the planter 12 of the first individual planter packaging arrangement 10, as demonstrated in FIG. 6. As may be seen, additional planter packaging arrangements may be stacked together to create a column.

For comparison purposes, as shown in FIG. 6, the individual planter packaging arrangements 10/10' are shown stacked together, adjacent to a traditional individual planter packaging 500 for a ceramic planter. Traditional individual planter packaging 500 is configured to only accommodate a single planter 12. A series of four traditional individual planter packaging 500 are stacked in a successive manner on the right portion of the FIG. 6, which yields a height of X.

However, as shown in the left side of FIG. 6, using the individual planter packaging arrangements 10/10', a stack at a height of X may include 8 individual planter packaging arrangements 10/10'. Moreover, unlike the traditional individual packaging, the successive units are secured together, reducing the likelihood of the packaging falling over when stored on a shelf or when physically transporting a series of the individual planter packaging arrangements 10/10'.

Further, the grasping elements 36 facilitate easy removal and transport of a stack of individual planter packaging arrangements 10/10'. For example, if one requires two individual planter packaging arrangements 10/10', one may insert fingers/hands/ or other grasping arrangement into the grasping element 36' of individual planter packaging arrangement 10', beneath individual planter packaging arrangement 10 and lift those two simultaneously off the stack of the remaining individual planter packaging arrangements and transport them. The nesting arrangement secures the two individual planter packaging arrangements together. In contrast, lifting multiple prior art arrangements can be cumbersome and/or difficult, especially as the boxes are not secured together and must be carefully balanced or the top boxes 500' may become dislodged and separated from a bottom box 500".

As planters 12 are often made of ceramic material that may be prone to starching or other surface damage, it is contemplated that after a stack is formed, an anti-abrasion bag or plastic may encircle the completed stack. Alternatively, each planter 12 may be encased in an anti-abrasion material, such as a plastic wrap before being mounted in the packaging element 14.

In another exemplary arrangement, instead of a single planter 12, the sidewalls 30 may be sized to permit a stack of nested planters 12 disposed within a single packaging element 14. An anti-abrasion material, such as a polymeric bag may encircle the stack of nested planters 12 before the planters 12 are disposed within the packaging element 14. With this arrangement, even more planters may be packaged together.

Referring to FIGS. 7A-13, an alternative planter packaging arrangement 100 is shown. The planter packaging arrangement 100 includes at least one planter 12 partially mounted in a packaging element 114. In the exemplary arrangement shown in FIGS. 7A-13, a stack of planters 112 is partially mounted in the packaging element 114. Each planter 12 is similar to the planter 12 that shown in FIG. 3. More specifically, each planter is defined by a generally closed bottom surface 16, a top edge 18 (shown in phantom in FIG. 3) extending around an open top end 20 and a body portion 22 extending between the bottom surface 16 and the open top end 20. The bottom surface 16 is configured with a cross-sectional area that is smaller than a cross-sectional area of the open top end 20. In this manner, the body portion 22 flares or tapers outwardly from the bottom surface 16 to the open top end 20. The body portion 22 may include an outer rim element 24 disposed on an outer surface of the body portion 22 that extends from open top end 20. Alternatively, the top edge 18 may flare outwardly from the body portion 22, similar to a bell.

Figure 7A:
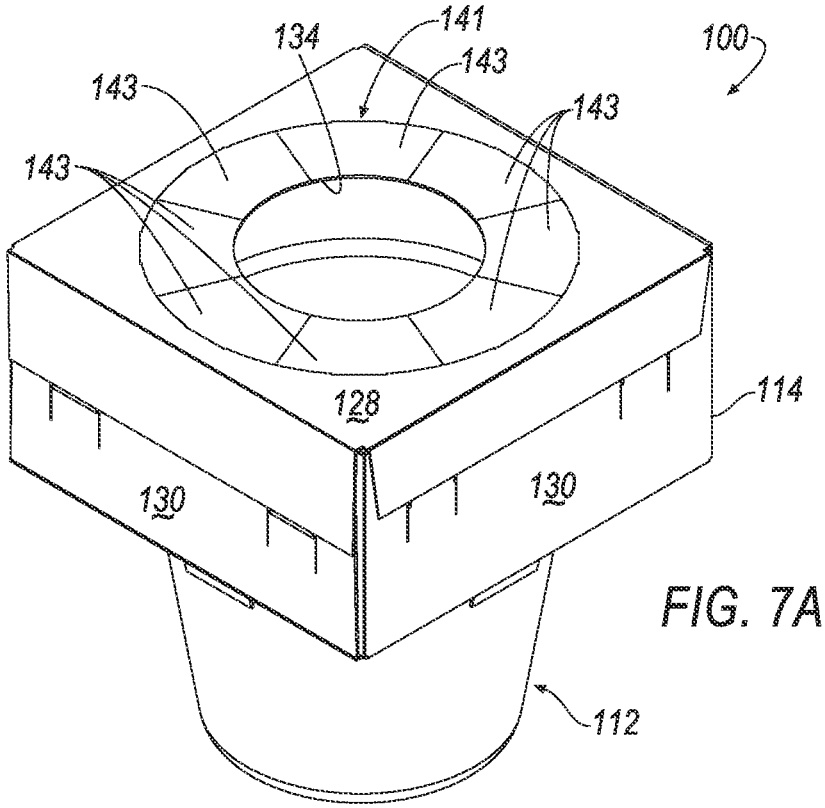
FIG. 7A is a bottom perspective view of an alternative configuration of a planter packaging arrangement.
Figure 7B:
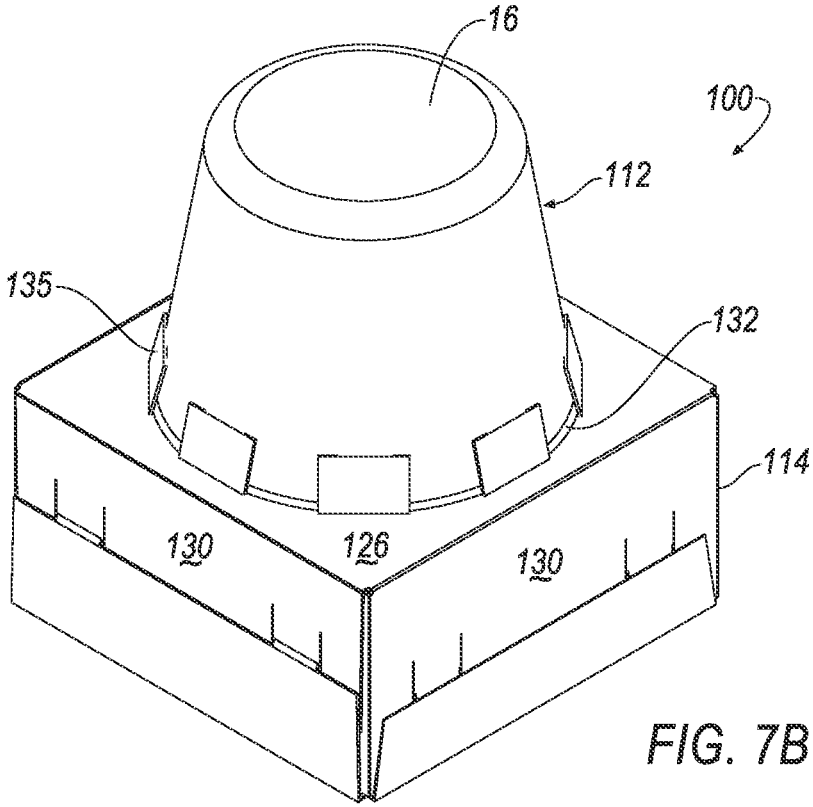
FIG. 7B is a top perspective view of the planter packaging arrangement of FIG. 7A.
Figure 8:
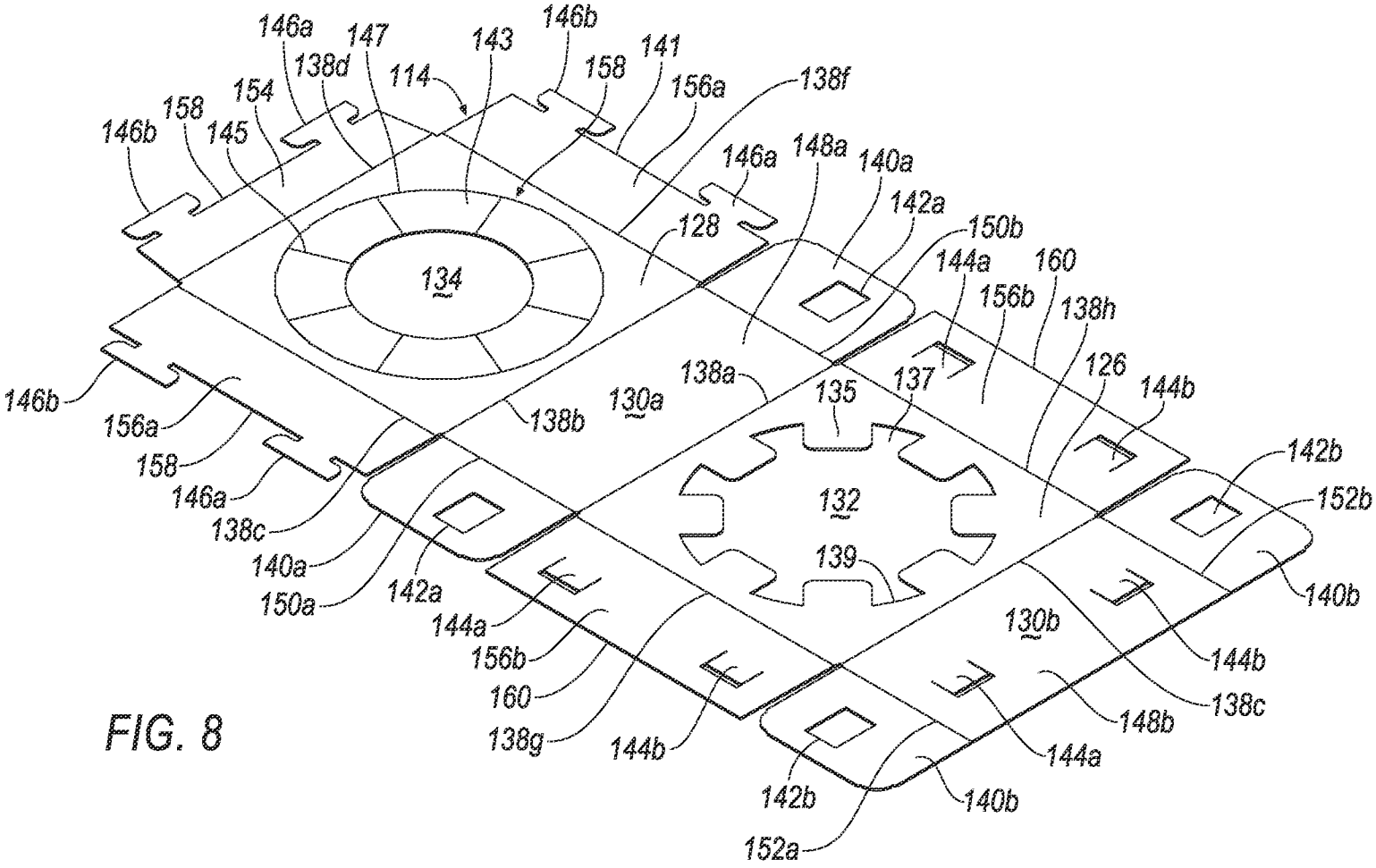
FIG. 8 is a perspective view of a packaging element in an initial unformed configuration.
Figure 9:
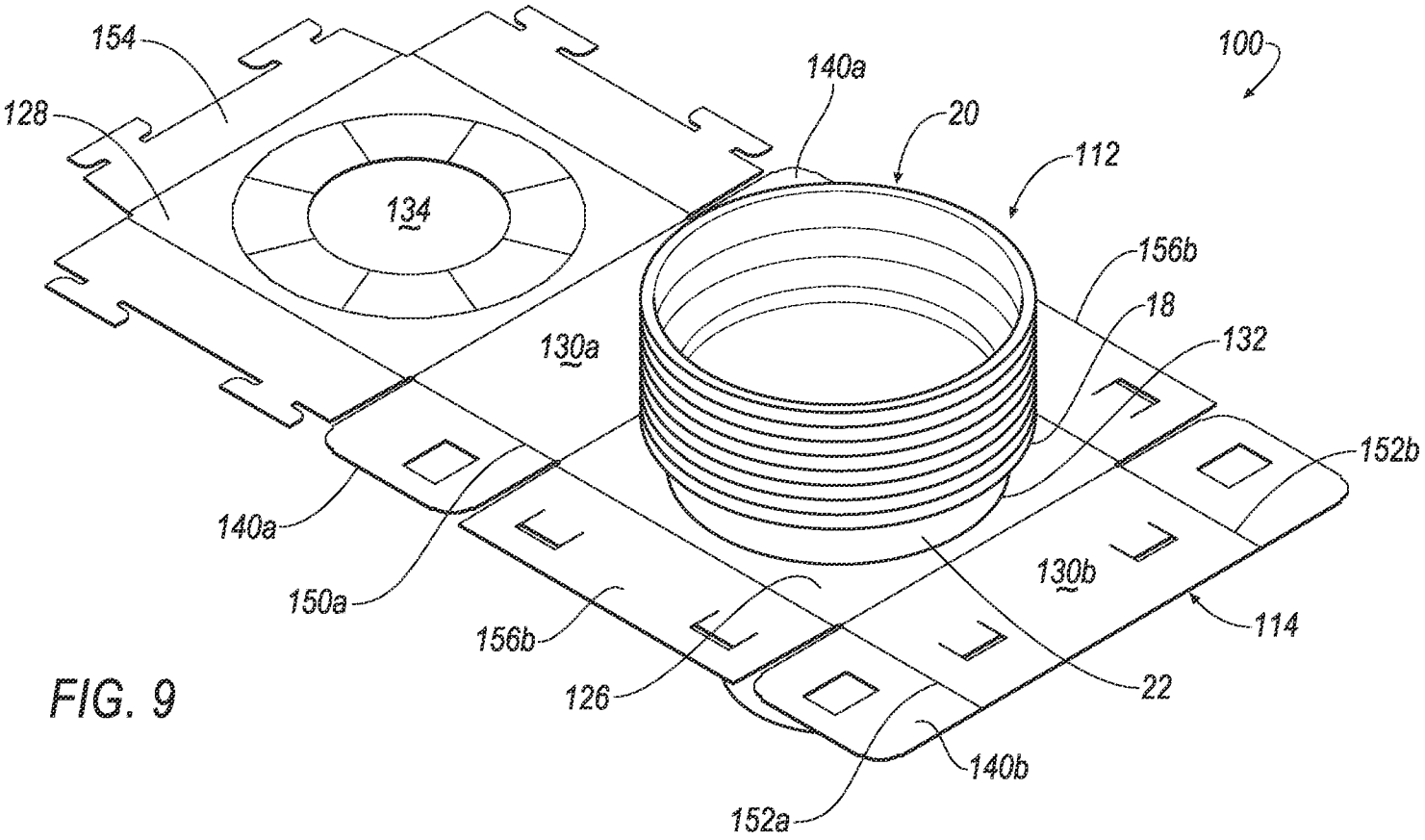
FIG. 9 is a perspective view of the packaging element in the initial unformed configuration with a planter stack partially mounted within the packaging element.

The packaging element 114 is defined by spaced apart generally opposing first 126 and second 128 surfaces that are joined together by four sidewalls 130. In one exemplary arrangement, portions of the sidewalls 130 may be integral with the top 126 and bottom 128 portions, as illustrated in FIGS. 8-9. The first surface 126 includes a first opening 132 disposed therethrough. The second surface 128 includes a second opening 134 disposed therethrough. When the packaging element 114 is positioned in an assembled configuration, such as that shown in FIGS. 7A-7B, the first and second openings 132, 134 are generally aligned such that a central axis extends through a center of both first and second openings 132, 134.

The first opening 132 is defined with a plurality of tabs 135 and recesses 137 extending around the periphery 139 of the first opening 132. In one exemplary arrangement, the tabs 135 are configured with a generally rectangular shape. In one exemplary arrangement, the recesses 137 are configured with a generally trapezoidal shape. Operation of the tabs 135 will be explained in further detail below.

The second opening 134 is defined with an outer ring 141 surrounding the opening 134. Outer ring 141 is made up of a plurality of joined segments 143. The segments 143 are joined together by a perforated segment 145 that starts at opening 134 and terminated at the outer periphery 147 of outer ring 141. Operation of the joined segments 143 will be explained in further detail below.

In one exemplary arrangement, side walls 130 are formed of multiple sidewall elements that interconnect to form the side walls 130. For example, referring to FIGS. 8 and 9, a center sidewall **130*a* is positioned between first and second surfaces 126, 128. Where center sidewall 130*a* joins first surface 126 there is a first fold line 138*a*. Where center sidewall 130*a* joins bottom surface there is a second fold line 138*b*. Center sidewall 130*a* further includes first end center connectors 140*a* that include a first connection center element 142*a* that cooperates with a second and third connection elements 144*a*, 146*a*, as will be explained in further detail below. First end center connectors 140*a* are attached to a central portion 148*a* of center sidewall 130*a* along end connector fold lines 150*a*, 150*b***, respectfully.

End sidewall **130*b* is attached to first surface 126 by third fold line 138*c* opposite first fold line 138*a*. End sidewall 130*b* further includes second end connectors 140*b* that each include the second connection elements 142*b* that cooperate with second and third connection elements 144*b*, 146*b*, as will be explained in further detail below. Second end connectors 140*b* are attached to a central portion 148*b* of end sidewall 130*b* along end connector fold lines 152*a*, 152*b***, respectfully.

A lateral connector 154 is attached to second surface 128 by a fourth fold line **138*d*, opposite first fold line 138*a*. Lateral connector 154 carries third connection elements 146*a*, 146*b*. Extending along opposing edges of second surface 128 are side connectors 156*a*. First side connectors 156*a* are connected to second surface 128 by fold lines 138*e* and 138*f*. First side connectors 156*a* each carry third connection elements 146*a*, 146*b*. Connector elements 146*a*, 146*b* extends outwardly from and edge 158 of lateral and first side connectors 154, 156*a***.

Second side connectors 156*b* are connected to first surface 126 by fold lines 138*g* and 138*h*. Second side connectors each carry second connection elements 144*a*, 144*b*. Second connection elements 144*a*, 144*b* are positioned inbound of an outer edge 160 of second side connectors 156*b*.

Figure 10B:
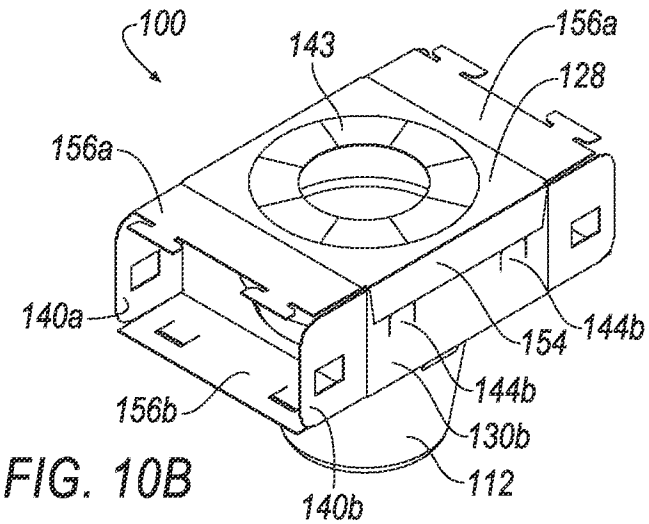
FIG. 10B is a perspective view of the packaging element in a second partially assembled configuration.
Figure 10A:
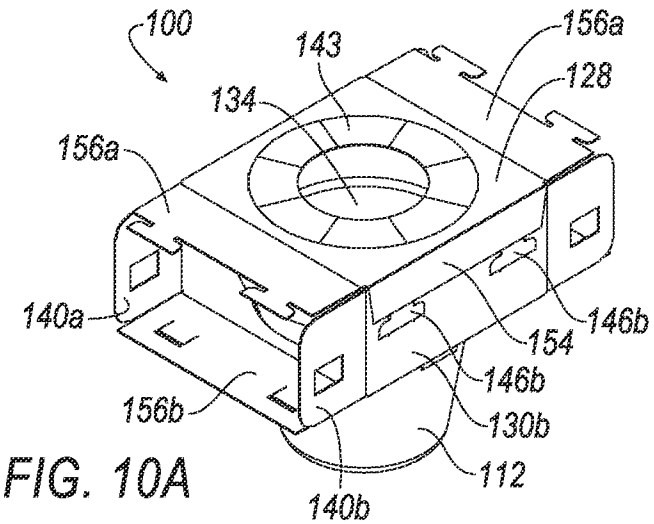
FIG. 10A is a perspective view of the packaging element in a first partially assembled configuration.
Figure 10D:
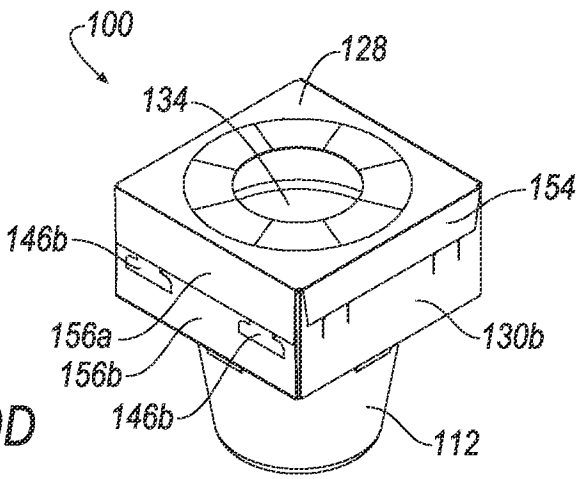
FIG. 10D is a perspective view of the packaging element in a fourth partially assembled configuration.

Referring to FIGS. 9-10D, assembly of the planter packaging arrangement 100 will now be described. Assembly of planter packaging arrangement 100 may begin with the packaging element 114 in an initial unformed configuration that is generally planar, as shown in FIGS. 8 and 9. This configuration allows for easy storage of the packaging element 114 until needed, as well as efficient shipment of the packaging element 114, as all the packaging elements 114 may be stacked together until needed.

Figure 11A:
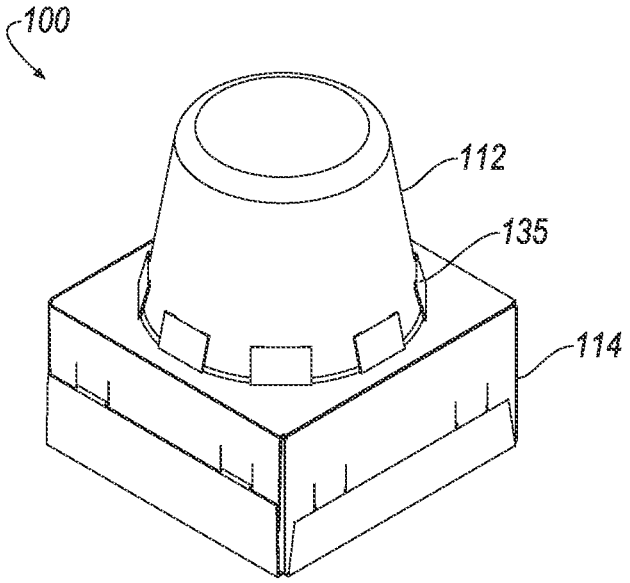
FIG. 11A is a perspective view of the fully assembled packaging element with the planter stack disposed within the packaging element.
Figure 11B:
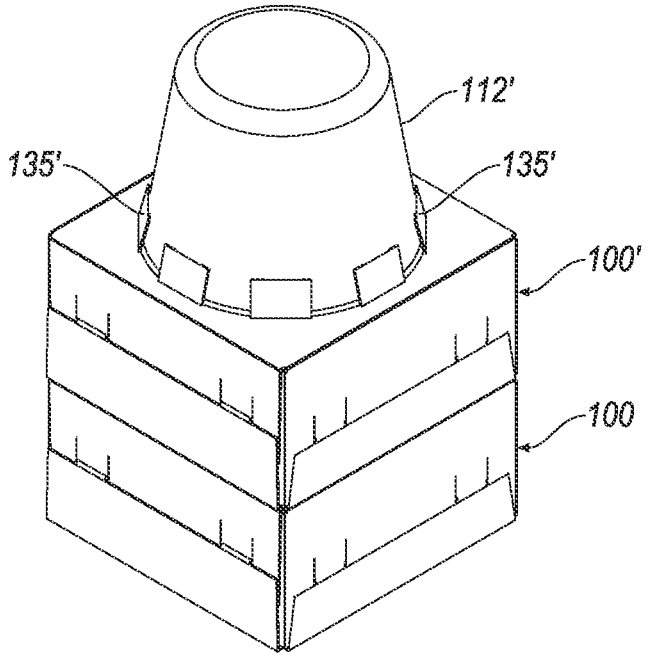
FIG. 11B is a perspective view of multiple packaging elements with successive planter stacks disposed within the packaging elements stored together.

When it is desired to use the packaging elements 114 with planters 12, a stack of planters 112 are nested together, as shown in FIG. 9. In one exemplary arrangement, the stack of nested planters 112 are then encased in an anti-abrasion material, such a polymeric bag, which may encircle the stack of nested planters. The stack of nested planters 112 are then positioned through the first opening 132, with the bottom surface 16 of the lowermost planter 12 (lowermost being defined when the stack of planters 112 are arranged with the open top ends facing down) in the stack being directed through the first opening 132. The top edge 18 of the lowermost planter 12 is slightly larger than the periphery 139 of the first opening 132 (defined by the depth of recesses 137) such that the top edge 18 rests against the first surface 126. During insertion of the stack of planters 112, the tabs 135 are forced to flex to extend along an outer surface of the body portion 22 of the lowermost planter 112, as shown in FIGS. 7B and 11B. The tabs 135 exerts a slight compressive force on the outer surface of the lowermost planter 112 to provide stability of the planters 112 within the packaging element 114.

Once the planters 112 are positioned, the sidewall 130*a* is pivoted along fold line 138*a* such that the center sidewall 130*a* is oriented upwardly with respect to the first surface 126 (i.e., generally perpendicular to a plane in which the first surface 126 lies). Next, the second surface 128 is pivoted along fold line 138*b* such that second surface 128 overlies first surface 126 (i.e., so as to be generally parallel t the first surface 126) and first opening 132 is aligned with second opening 134, as shown in FIG. 10A. End sidewall 130*b* is pivoted along fold line 138*c* toward center sidewall 130*a* so as to be disposed generally parallel to the center sidewall 130*a*. The third connection elements 146*a*, 146*b* are mated with cooperating connection elements second connection elements 144*a*, 144*b*. In one exemplary arrangement, third connection elements 146*a*, 146*b* are configured as tab members and the second connection elements 144*a*, 144*b* are configured as detent members. With this arrangement, the third connection elements 146*a*, 146*b* force the second connection elements 144*a*, 144*b* inwardly, with ends of the third connection elements 146*a*, 146*b* being disposed against an inner surface of the sidewall 130*b*. In this manner, the second surface 126 is secured in position with respect to the first surface 124, as shown in FIG. 10B.

Figure 10C:
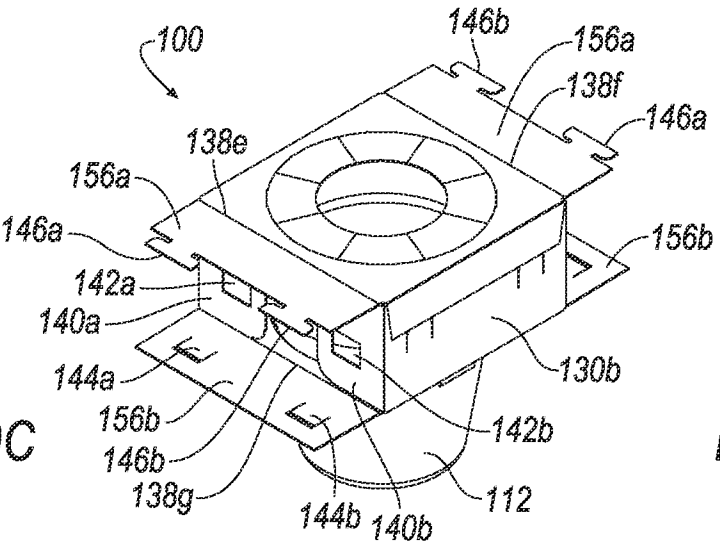
FIG. 10C is a perspective view of the packaging element in a third partially assembled configuration.

Next, referring to FIG. 10C, the first and second end connectors 140*a* and 140*b* bent toward each other about fold lines 150*a*, 150*b*, 152*a*, and 152*b*, respectively. The second side connectors 156*b* are bent upwardly along fold lines 138*g* and 138*h*, respectively to overlay the first and second end connectors 140*a*, 140*b*. The first side connectors 156*a* are bent downwardly along fold lines 138*e* and 138*f*, respectively to overlay the second side connectors 156*b* respectively, as shown in FIG. 10D. Once the end connectors and first and second side connectors are positioned in this manner, these elements are secured together. For example, the second connection elements 144*a*, 144*b* are pushed into the first connection elements 142*a*, 142*b*, which are configured as connection openings. Next, the third connection elements 146*a*, 146*b* are disposed through the first connection elements 142, 142*b*, which positions ends of the third connection elements 142, 142*b* in frictional engagement against an inside surface of the first and second end connectors 140*a*, 140*b*. With this configuration, the top edges 18 of the planters 112 are enclosed within the packaging element 114, as shown in FIG. 11A to form the planter packaging arrangement.

Second connection elements 144*b* may also function as grasping element. More specifically, second connection elements 144*b* may be pressed inwardly and sized to receiving fingers or other grasping elements to lift one or more packaging arrangements.

Much like the arrangement shown in FIG. 6, the planter packaging arrangement 100 is configured to permit selective stacking of successive planter packaging arrangements 100. More specifically, referring to FIG. 11B, a second planter packaging arrangement 100' is disposed over a first planter packaging arrangement 100. The bottom surface 16 of the planter 112 for the first planter packaging arrangement 100 extends through the second opening 134 of the individual planter packaging arrangement 100' to nest within the body portion 22 of the planter 112 of the first individual packaging arrangement 100, as demonstrated in FIG. 12A. The joined segments 143 surrounding the second opening 134 will separate along perforated lines 145 to serves as a stabilizing element on both the inside surface of the body portion 22' of the lowermost planter 112' of the second planter packaging arrangement 100', as well as serving as a stabilizing element on the outside surface of the body portion 22 of the uppermost planter 112 of the first planter packaging arrangement 100. As may be seen, additional planter packaging arrangements may be stacked together to create a column.

Figure 12A:
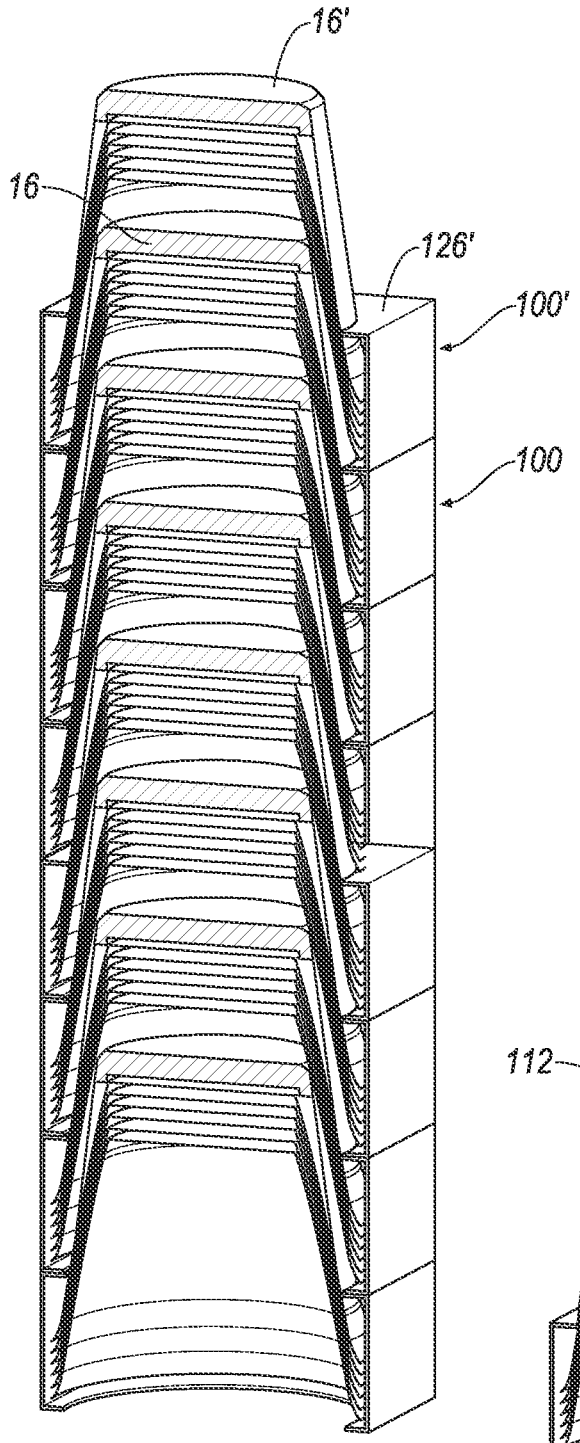
FIG. 12A is a cross-sectional view of a stack of multiple packaging arrangements.
Figure 12B:
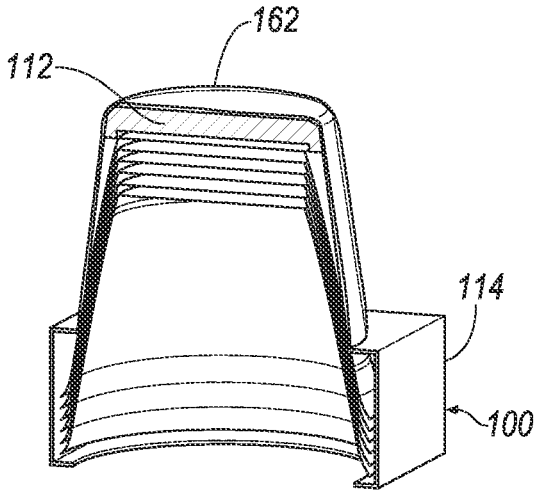
FIG. 12B is a cross-sectional view of the packaging arrangement of FIGS. 7A and 7B with a protective cover thereon.
Figure 13:
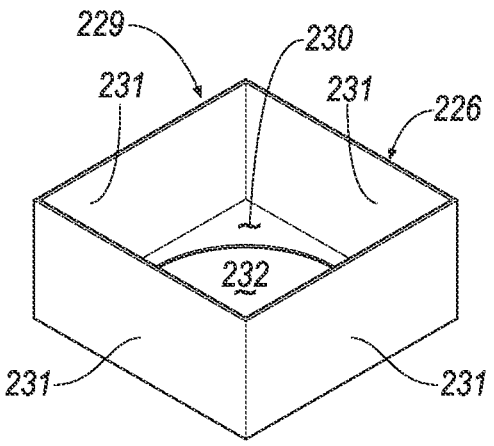
FIG. 13 is a perspective view of a first element of an alternative packaging arrangement.
Figure 14:
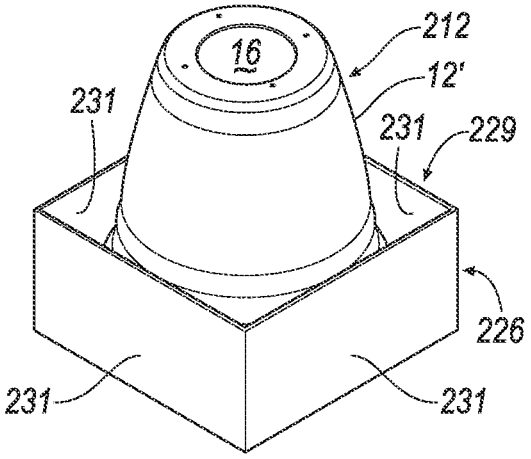
FIG. 14 is a perspective view of a planter stack disposed within the first element of the packaging arrangement of FIG. 13.
Figure 15:
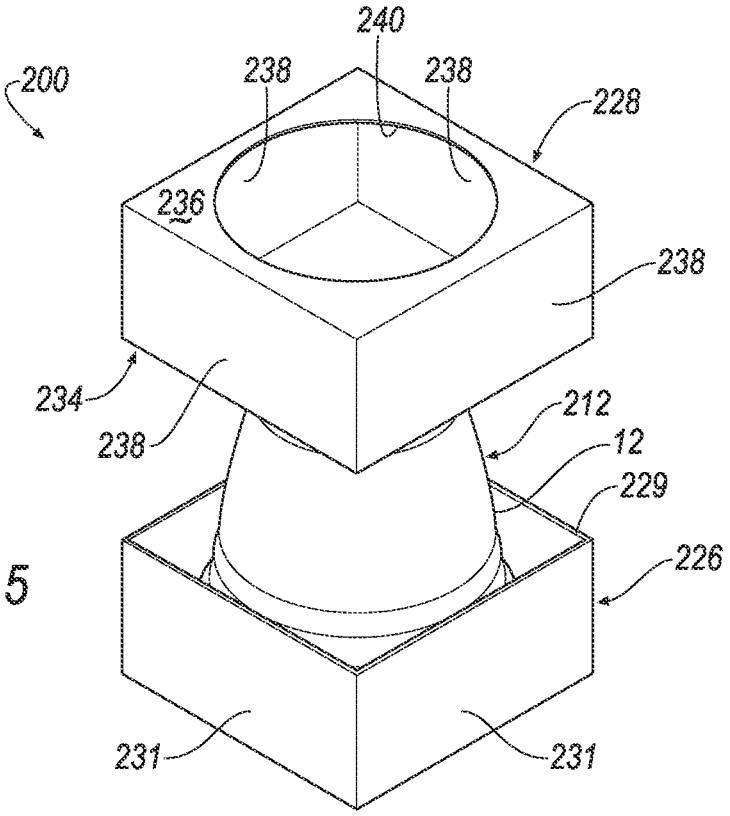
FIG. 15 is a partially exploded view of the alternative packaging arrangement illustrating a second element that is disposable over the first element of the packaging arrangement of FIG. 15.
Figure 16:
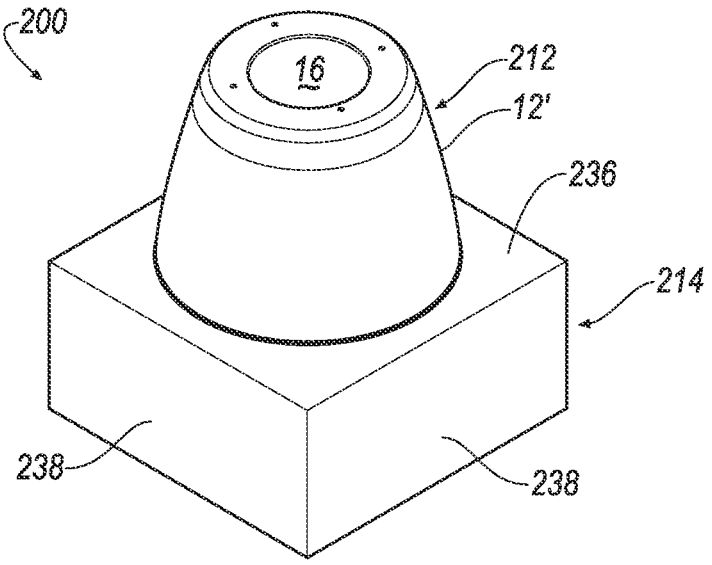
FIG. 16 is a perspective view of the assembled alternative packaging arrangement.
Figure 17:
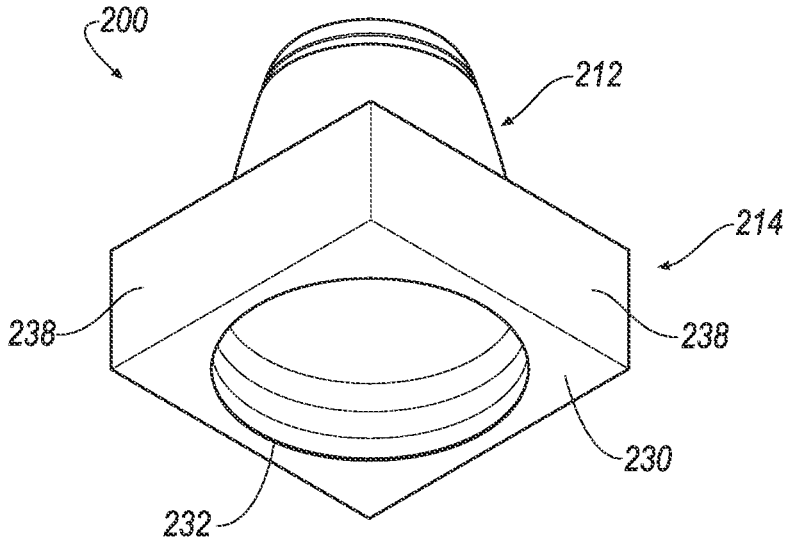
FIG. 17 is a bottom perspective view of the assembled alternative packaging arrangement of FIG. 16.

As discussed above, each stack of planters 112 may be enclosed in an anti-abrasive covering, such as a such as a polymeric bag 162 to protect against damage, as shown in FIG. 12B.

Referring to FIGS. 13-17, a third planter packaging arrangement 200 is shown. Planter packaging arrangement 200 includes at least one planter 12 partially mounted in a packaging element 214. In the exemplary arrangement shown in FIGS. 13-17, a stack of planters 212 are partially mounted in the packaging element 214. Each individual planter in the stack of planters 212 is similar to the planter 12 that shown in FIG. 3 and described above. While not shown in this particular arrangement, the stack of planters 212 may also be enclosed in an anti-abrasive material, such as polymeric bag 162.

The packaging element 214 is defined by a first element 226 and a second element 228 that may be selectively joined together to define packaging element 214. In one exemplary arrangement, the first element 226 is configured with an open top 229, a bottom surface 230, and four side walls 231 extending upwardly from the bottom surface 230. Bottom surface 230 further includes a first opening 232 extending therethrough. First opening 232 is sized to be smaller than the outer periphery defined by the top edge 18 of the lowermost planter 12 in the planter stack 212.

Second element 228 generally corresponds to the first element 226. More specifically, second element 228 includes an open bottom 234, a top surface 236, and four side walls 238 extending downwardly from the top surface 236. Top surface 236 further includes a second opening 240 extending therethrough. Second opening 240 is also sized to be smaller than the outer periphery defined by the top edge 18 of planter 12. The four side walls 231, 238 may be integral with the top 236 and bottom 230 portions, respectively. When the packaging element 214 is positioned in an assembled configuration, such as that shown in FIGS. 15-17, the first and second openings 232, 240 are generally aligned such that a central axis extends through a center of both first and second openings 232, 240.

To assemble planter packaging arrangement 200, the planter stack 212 is positioned within the first element 226 with the planter stack 212 being positioned with the open top end 20 facing downwardly on to the bottom surface 230 of the first element 226, surrounding the first opening 232. The first opening 232 provides access to the interior of the bottom-most planter 12 within the planter stack 212.

Once positioned, the second element 228 is disposed over the bottom end 16 of the uppermost planter 12' in the planter stack 212 such that the bottom end 16 of the planter stack 212 extends through the second opening 240. The side walls 238 of the second element 228 are then slid over on top of the four side walls 231 of the first element 226 to lock the top edges 18 of the planter stack 212 within the packaging element 214.

However, like the packaging arrangements 14 and 114, the packaging element 214 provides for an opening 232 at the bottom of the packaging 214 that is allows for a second stack of planters (not shown) to be nested therewithin, in a similar manner as that shown in FIG. 12A.

While not shown, it is also understood that packaging element 214 may include one or more grasping elements, such as that shown in connection with packaging arrangements 14 and 114.

It is to be understood that the above description is intended to be illustrative and not restrictive. Many embodiments and applications other than the examples provided would be apparent upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A planter packaging assembly, comprising:

unitary packaging defined by a first edge and a first wall joined together by a sidewall;

the first edge having a first opening;

the first wall having a second opening;

at least one planter mounted within the first opening, the planter defined by a bottom surface, an open top end and a body portion therebetween;

wherein the at least one planter is disposed within the first opening of the first edge of the packaging; and wherein the first wall of the packaging is selectively pivotable about the sidewall such that the first edge is parallel to the first wall and the second opening is aligned with the open top end of the at least one planter such that an interior of the at least one planter is accessible through the second opening of the packaging, and wherein the first wall is connected to the first edge to capture the open top end of the at least one planter within an interior defined by the packaging; and wherein the first opening or the second opening is defined by a periphery and a plurality of alternated tabs, wherein when the at least one planter is disposed within the first opening of the packaging, the tabs are bent with respect to the first edge or the first wall to engage against the body portion of the at least one planter to stabilize the at least one planter.

2. The planter packaging assembly of claim 1, wherein the planter packaging assembly includes a stack of planters that are mounted within the first edge, in a nested configuration.

3. The planter packaging assembly of claim 1, wherein the first edge or the first wall includes a selectively deformable outer ring surrounding the second opening.

4. The planter packaging assembly of claim 1, wherein the unitary packaging further comprises a center sidewall and an end sidewall, the center sidewall joining the first edge and the first wall, the end sidewall joined to the first edge.

5. The planter packaging assembly of claim 4, wherein the unitary packaging further comprises a lateral connector joined to the first wall, wherein the lateral connector further includes at least one lateral connection that cooperates with a corresponding end connection to secure the first edge and the first wall in a spaced apart and parallel arrangement, with the first open top end of the at least one planter disposed therebetween.

6. The planter packaging assembly of claim 1, wherein the first edge further comprises a second wall.

7. The planter packaging assembly of claim 1, wherein the first wall further comprises a plurality of segments radially extending from the second opening.

8. The planter packaging assembly of claim 1 wherein a plurality of recesses is formed about the periphery with the plurality of tabs.

9. The planter packaging assembly of claim 1 wherein the plurality of tabs engage an outside body portion of the at least one planter.

10. A first planter packaging assembly, and a second planter packaging assembly, each according to claim 1, wherein the second planter packaging assembly is stacked upon the first planter packaging assembly so that the at least one planter of the first planter packaging assembly is received within the second opening of the second planter packaging assembly whereby the plurality of tabs of the first planter packaging assembly or the second planter packaging assembly engages an outside portion of the at least one planter of the first planter packaging assembly.

11. A planter packaging assembly, comprising:

packaging defined by a first edge and a first wall;

the first edge is defined by a first surface, and two pairs of opposing side walls that extend upwardly from the first surface and define a general opening, the first surface further defines a first through opening therethrough;

the first wall is defined by a second surface and two pairs of opposing side walls that extend from the second surface and define a general opening, the second surface further defines a second through opening therethrough; and a plurality of planters mounted within the first edge, each planter defined by a bottom surface, an open end, and a body portion therebetween;

wherein the open end of the each of the plurality of planters is disposed within the first edge of the packaging with the open end of each of the plurality of planters aligned with one of the through openings such that an interior of at least one of the plurality of planters is accessible, and wherein the first wall is connected to the first edge such that a portion of the body portion of each of the plurality of planters extends through one of the through openings of the packaging such that the bottom surface of the at least one of the plurality of planters is disposed out of the packaging; and wherein one of the through openings is smaller than the other through opening.

12. The planter packaging assembly of claim 11, wherein the plurality of planters is stacked in a nested configuration.

13. The planter packaging assembly of claim 11, wherein the planter packaging assembly and the plurality of planters mounted therein are stacked on top of a second planter packaging assembly and a second plurality of planters identical to the planter packaging assembly and the plurality of planters such that the bottom surface of at least one of the plurality of second planters is received within the interior of the plurality of planters such that the body portion of the second plurality of planters is nested within the interior of the plurality of planters and the first or second surface of the packaging assembly rests against the first or second surface of the second packaging assembly.

14. The planter packaging assembly of claim 11, wherein the first wall is disposed over the first edge such that the pairs of side walls of the first edge or the first wall surround the pairs of side walls of the first edge or the first wall.

15. The planter packaging assembly of claim 11 wherein the through opening of the first edge and the through opening of the first wall are axially aligned.

16. The planter packaging assembly of claim 11 wherein the plurality of planters is nested.

17. The planter packaging assembly of claim 11, wherein the first through opening is defined with a plurality of tabs and recesses extending around a periphery;

wherein the second through opening is defined by an outer ring of a plurality of contacting segments, the second surface being spaced apart and opposing the first surface such that the first through opening and the second through opening are axially aligned;

wherein the plurality of planters is nested; and wherein at least one of the plurality of nested planters contacts at least one of the plurality of tabs and at least another of the plurality of nested planters interacts with the plurality of contacting segments.

18. The planter packaging assembly of claim 17 wherein each of the tabs has a generally rectangular shape.

19. A plurality of planter packaging assemblies comprising a first planter packaging assembly and a second planter packaging assembly, each according to claim 17 stacked such that first surface of the first planter packaging assembly contacts the second surface of the second planter packaging assembly such that the body portion of the plurality of planters of the first or second planter packaging assembly extends into the opening of at least one of the plurality of planters of the first or second planter packaging assembly.

20. The plurality of planter packaging assemblies of claim 19 wherein at least one of the plurality of planters of the first and second planter packaging assemblies contact the plurality of tabs and the plurality of contacting segments of the first and second planter packaging assemblies.

* * * * *